US010405576B1

(12) United States Patent
Adams

(10) Patent No.: US 10,405,576 B1
(45) Date of Patent: Sep. 10, 2019

(54) PORTABLE SMOKE FILTERING SYSTEM

(71) Applicant: Matthew Adams, Belleair Beach, FL (US)

(72) Inventor: Matthew Adams, Belleair Beach, FL (US)

( * ) Notice: Subject to any disclaimer, the term of this patent is extended or adjusted under 35 U.S.C. 154(b) by 414 days.

(21) Appl. No.: 15/000,992

(22) Filed: Jan. 19, 2016

(51) Int. Cl.

| | |
|---|---|
| ***A24F 13/00*** | (2006.01) |
| ***A24D 3/04*** | (2006.01) |
| ***A24D 3/06*** | (2006.01) |
| ***A24F 1/02*** | (2006.01) |

(52) U.S. Cl.
CPC ..... *A24F 13/00* (2013.01); *A24D 3/04* (2013.01); *A24D 3/06* (2013.01); *A24F 1/02* (2013.01)

(58) Field of Classification Search
CPC ..... A24F 13/00; A24F 13/06
See application file for complete search history.

(56) References Cited

U.S. PATENT DOCUMENTS 5,160,518 A * 11/1992 Vega, Jr. ..... A24F 13/00 131/200
5,353,814 A * 10/1994 Martin ..... A24F 13/00 131/175
5,388,595 A * 2/1995 Shafer ..... A24F 13/00 131/175
5,472,001 A * 12/1995 Nicholson ..... A24F 13/00 131/185
5,529,078 A * 6/1996 Rehder ..... A24F 13/00 131/175
2008/0230077 A1* 9/2008 Martilik ..... A24F 1/02 131/202
2011/0240047 A1* 10/2011 Adamic ..... A24F 1/00 131/328
2012/0186593 A1* 7/2012 Grano ..... A24D 3/041 131/202
2013/0233328 A1* 9/2013 Jang ..... A24F 13/00 131/187
2016/0331021 A1* 11/2016 Pero ..... A24F 13/00

OTHER PUBLICATIONS

Grasscity; https://forum.grasscity.com/threads/air-filter-sploof-with-pics.1145508/ (Year: 2012).*

* cited by examiner

*Primary Examiner* — Eric Yaary

(57) ABSTRACT

A portable smoke filtering system has a central tube in a cylindrical configuration with a forward end and a rearward end. Male screw threads are formed in the forward end and the rearward end. An input tube in a cylindrical configuration has a forward end and a rearward end. The input tube has female screw threads. The forward end of the central tube is threadedly received in the rearward end of the input tube. A first filter has an interior surface and an exterior surface. The first filter is received in the input tube. Dryer sheets are provided in the central tube.

3 Claims, 4 Drawing Sheets

FIG. 4
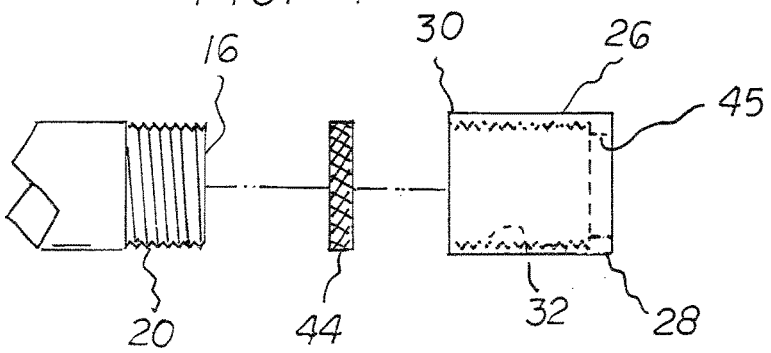
FIG. 5
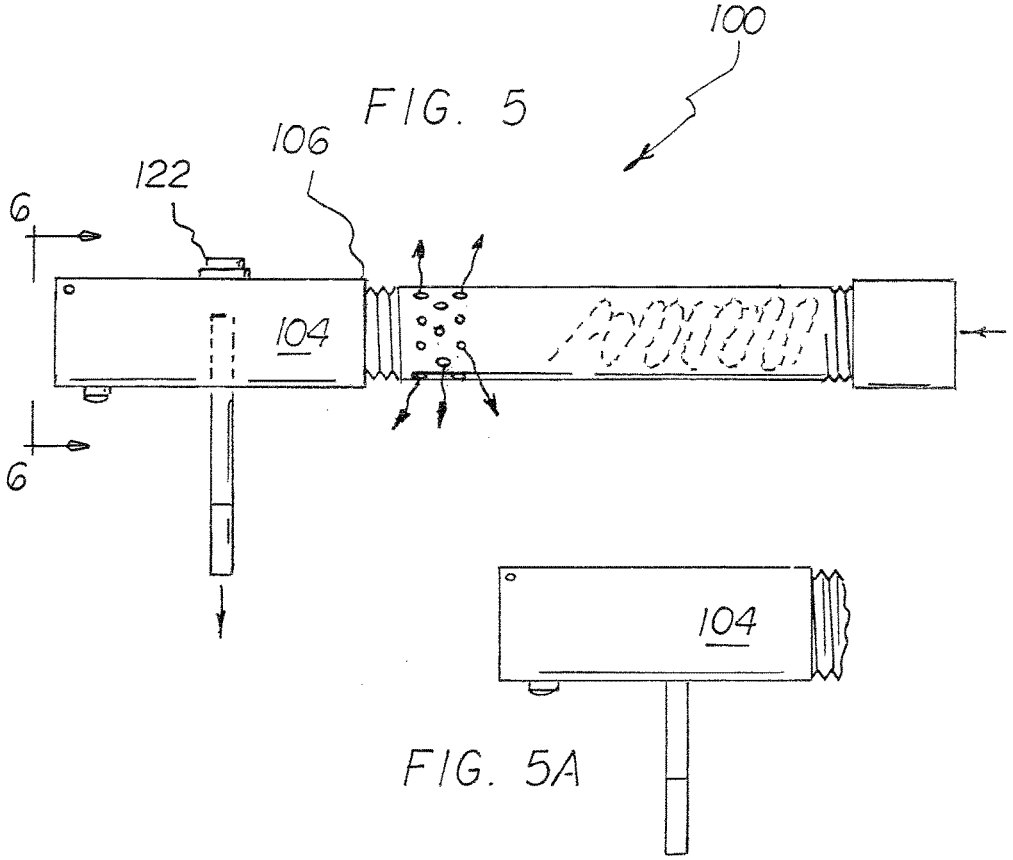
FIG. 5A

FIG. 9
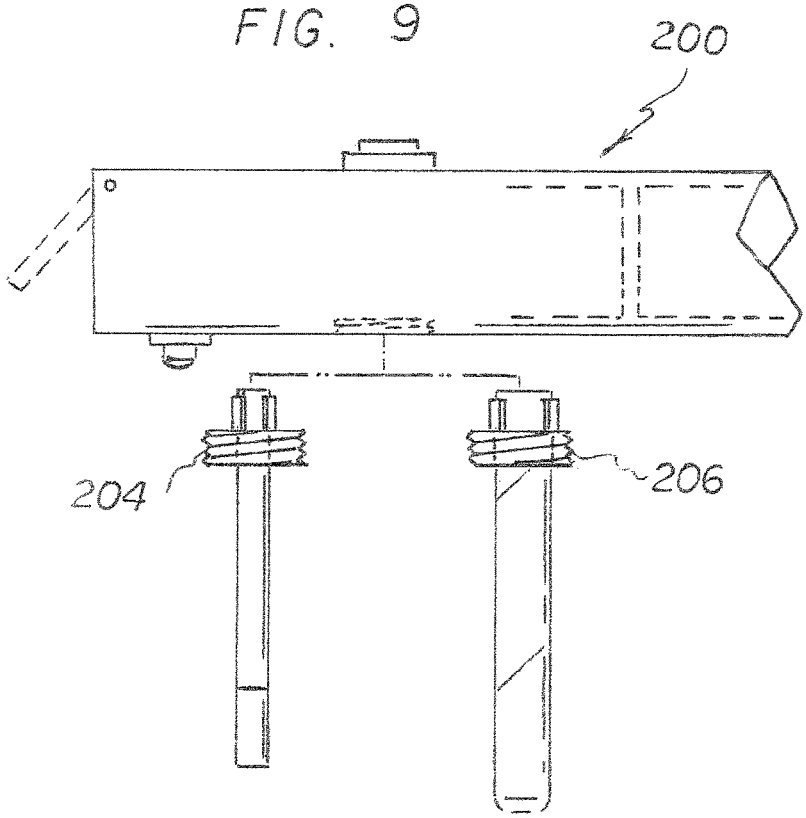
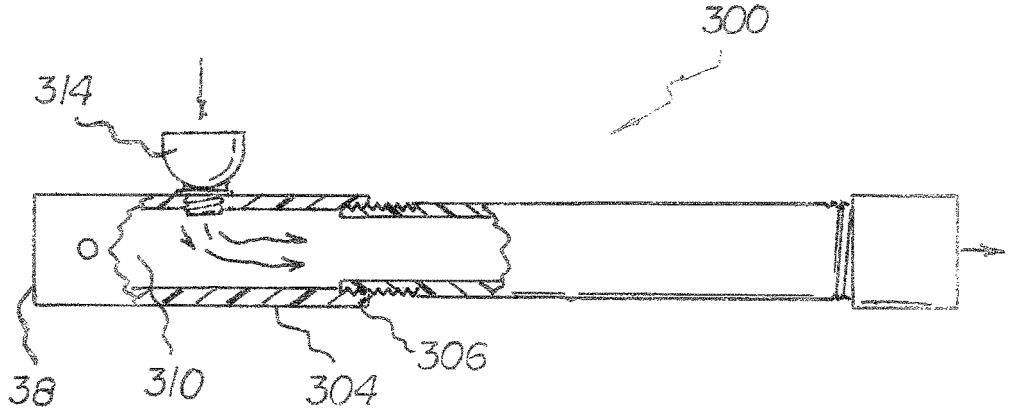
FIG. 10

PORTABLE SMOKE FILTERING SYSTEM

BACKGROUND OF THE INVENTION

Field of the Invention

The present invention relates to a portable smoke filtering system and more particularly pertains to removing foul odor from exhaled breath of a smoker and for retaining an environment clean of smoke while a smoker smokes, the removing of foul odors and the retaining an environment clean of smoke being done in a safe, sanitary, convenient, and economical manner.

Description of the Prior Art

The use of smoke filtering systems of known designs and configurations is known in the prior art. More specifically, smoke filtering systems of known designs and configurations Previously devised and utilized for the purpose of removing foul odor from a smoker's breath and retaining an environment clean of smoke are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a portable smoke filtering system for removing foul odor from exhaled breath of a smoker and for retaining an environment clean of smoke while a smoker smokes. The removing of foul odors and the retaining an environment clean of smoke is done in a safe, sanitary, convenient, and economical manner.

In this respect, the portable smoke filtering system according to the present invention substantially departs from the conventional concepts and designs of the prior art, and in doing so provides an apparatus primarily developed for the purpose of removing foul odor from exhaled breath of a smoker and for retaining an environment clean of smoke while a smoker smokes. The removing of foul odors and the retaining an environment clean of smoke is done in a safe, sanitary, convenient, and economical manner.

Therefore, it can be appreciated that there exists a continuing need for a new and improved portable smoke filtering system which can be used for removing foul odor from exhaled breath of a smoker and for retaining an environment clean of smoke while a smoker smokes. In this regard, the present invention substantially fulfills this need.

SUMMARY OF THE INVENTION

In view of the disadvantages inherent in the types of filtering systems of known designs and configurations now present in the prior art, the present invention provides an improved portable smoke filtering system. As such, the general purpose of the present invention, which will be described subsequently in greater detail, is for removing foul odor from exhaled breath of a smoker and for retaining an environment clean of smoke while a smoker smokes, the removing of foul odors and the retaining of an environment clean of smoke being done in a safe, sanitary, convenient, and economical manner.

To attain this, the present invention essentially comprises from a broad viewpoint, a portable smoke filtering system having a central tube in a cylindrical configuration. The central tube has a forward end and a rearward end. The central tube has male screw threads formed in the forward end and the rearward end. An input tube is cylindrical in configuration. The input tube has a forward end and a rearward end. The rearward end of the input tube has female screw threads. The forward end of the central tube is threadedly received in the rearward end of the input tube. A first filter has an interior surface and an exterior surface. The first filter is received in the input tube. Dryer sheets are provided in the central tube.

There has thus been outlined, rather broadly, the more important features of the invention in order that the detailed description thereof that follows may be better understood and in order that the present contribution to the art may be better appreciated. There are, of course, additional features of the invention that will, be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved portable smoke filtering system which has all of the advantages of the prior art smoke filtering systems of known designs and configurations and none of the disadvantages.

It is another object of the present invention to provide a new and improved portable smoke filtering system which may be easily and efficiently manufactured and marketed.

It is further object of the present invention to provide a new and improved portable smoke filtering system which is of durable and reliable constructions.

An even further object of the present invention is to provide a new and improved portable smoke filtering system which is susceptible of a low cost of manufacture with regard to both materials and labor, and which accordingly is then susceptible of low prices of sale to the consuming public, thereby making such portable smoke filtering system economically available to the buying public.

Lastly, it is an object of the present invention to provide a new and improved portable smoke filtering system for removing foul odor from exhaled breath of a smoker and for retaining an environment clean of smoke while a smoker smokes. The removing of foul odors and the retaining an environment clean of smoke is done in a safe, sanitary, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an exploded side elevational view of the front section of FIGS. 1 and 3.

FIG. 5 is a side elevational view of one alternate embodiment of the invention.

FIG. 5A illustrates an embodiment similar to FIG. 5 but with the igniter removed.

FIG. 9 is a side elevational view of a portion of another alternate embodiment of the invention.

FIG. 10 is a side elevational view of a final alternate embodiment of the invention.

The same reference numerals refer to the same parts throughout the various Figures.

DESCRIPTION OF THE PREFERRED EMBODIMENT

Figure 1:
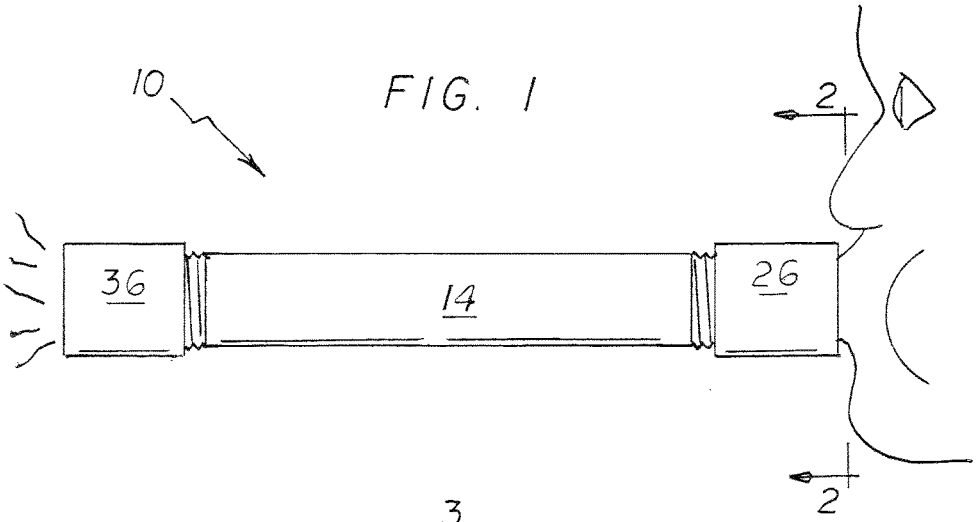
FIG. 1 is a side elevational view of a portable smoke filtering system constructed in accordance with the principles of the present invention.
Figure 2:
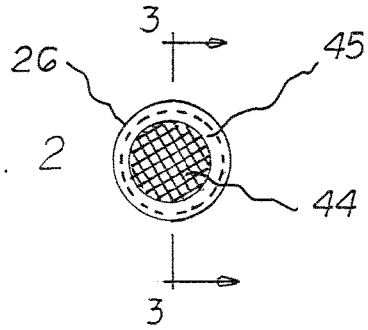
FIG. 2 is a front elevational view taken along line 2-2 of FIG. 1.
Figure 3:
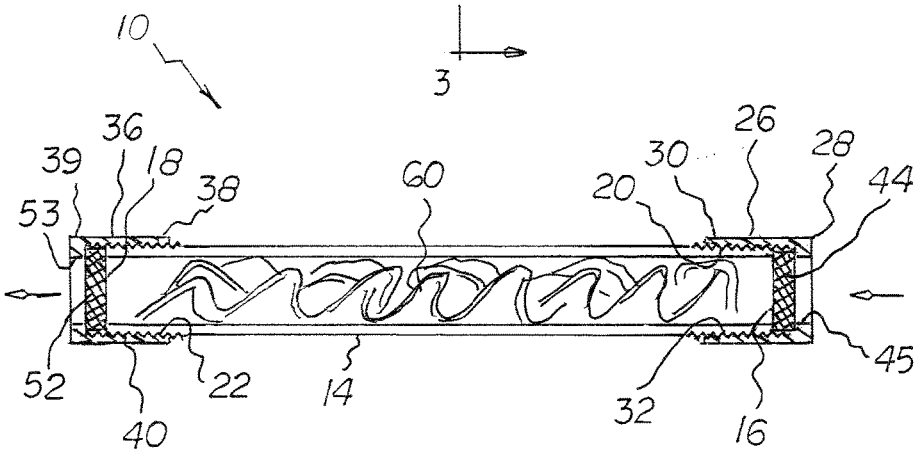
FIG. 3 is a cross sectional view taken along line 3-3 of FIG. 2.
Figure 6:
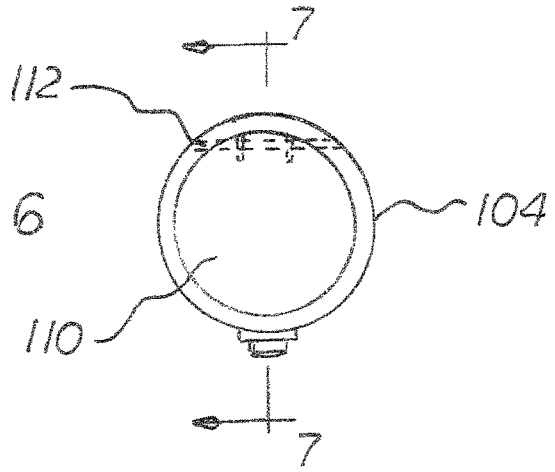
FIG. 6 is a rear elevational view taken along line 6-6 of FIG. 5.
Figure 7:
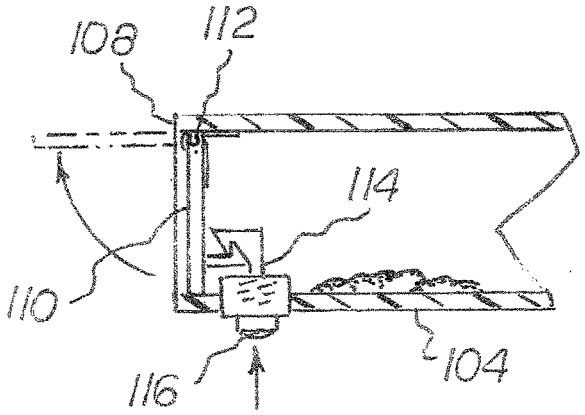
FIG. 7 is a cross sectional view taken along line 7-7 of FIG. 6 at the rear extent.
Figure 8:
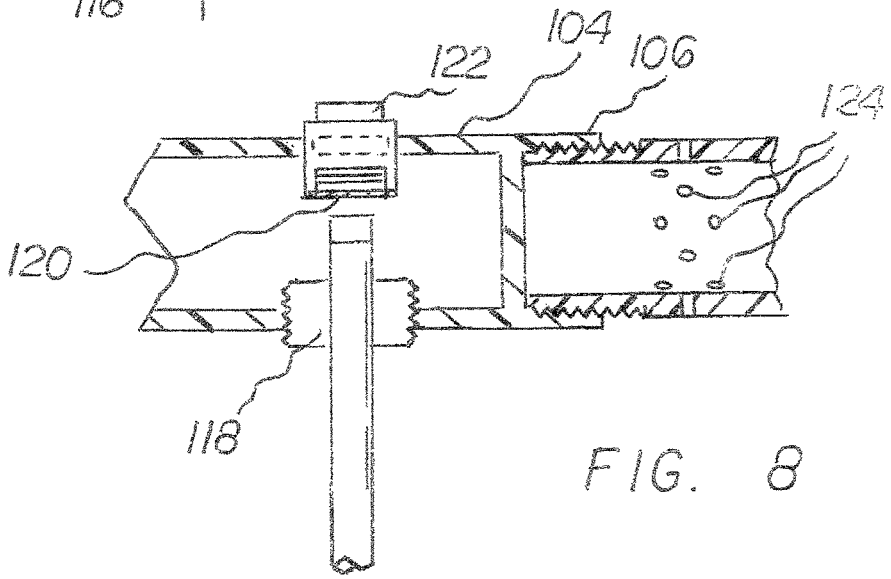
FIG. 8 is a cross sectional view taken along line 7-7 of FIG. 6 at an intermediate extent.

With reference now to the drawings, and in particular to FIG. 1 thereof, the preferred embodiment of the portable smoke filtering system embodying the principles and concepts of the present invention and generally designated by the reference numeral 10 will be described.

The present invention, the portable smoke filtering system 10 is comprised of a plurality of components. Such components in their broadest context include a central tube, an input tube, a first filter, and dryer sheets. Such components are individually configured and correlated with respect to each other so as to attain the desired objective.

From a specific viewpoint, the present invention is a portable smoke filtering system 10 having a central tube 14 in a cylindrical configuration. The central tube has an interior surface and an exterior surface. The central tube has a forward end 16 and a rearward end 18. The central tube has a first length. Male screw threads 20 are formed in the forward end. Male screw threads 22 are formed in the rearward end.

An input tube 26 in a cylindrical configuration is provided. The input tube has an interior surface and an exterior surface. The input tube has a forward end 28 and a rearward end 30. By the term "cylindrical configuration" it is not intended to limit the cross sectional configuration to a circle bur rather encompass any cross sectional configuration including ovals and rectangles and the like. The input tube has a second length. The second length is between 10 percent and 20 percent of the first length. The input tube has female screw threads 32 formed in the interior surface of the input tube. The forward end of the central tube is threadedly received in the rearward end of the input tube.

An output tube 36 in a cylindrical configuration is provided next. The output tube has an interior surface and an exterior surface. The output tube has a forward end 38 and a rearward end 39. The output tube has a third length. The third length is equal to the second length. The output tube has female screw threads 40 formed in the interior surface. The rearward end of the central tube is threadedly received in the forward end of the output tube.

Also provided is a first filter 44 held in position within the input tube. The first filter has an interior surface and an exterior surface. A first shoulder 45 contacts the first filter and secures the first filter between the first shoulder and the central tube. The first filter has a fourth length. The fourth length is between 20 percent and 30 percent of the second length.

Further provided is a second filter 52 held in position within the input tube. The second filter has an interior surface and an exterior surface. A second shoulder 53 contacts the second filter and secures the second filter between the second shoulder and the central tube. The second filter has a fourth length. The fourth length is between 20 percent and 30 percent of the second length. The central tube and the input tube and the output tube are fabricated of a rigid material.

Provided last are dryer sheets 60. The dryer sheets are positioned in the central tube. The dryer sheets have fabric strips with deodorant. In this manner a smoker desiring to mask afoul odor of smoke exhalant will blow smoke exhalant into the input tube and then through the first filter and then through the dryer sheets and then through the second filter. Further in this manner the output of the output cylinder will be devoid of a foul odor.

An alternate embodiment of the invention is illustrated in FIGS. 5 through 8. In this alternate embodiment, the portable smoke filtering system 100 includes a supplemental tube 104. The supplemental tube has forward end 106 and a rearward end 108. The forward end of the supplemental tube is threadedly coupled to the rearward end of the central tube. A chamber 109 is formed in the supplemental tube. A door 110 is provided. The door is circular in configuration. A hinge 112 is provided. The hinge pivotably couples the door to the rearward end of the supplemental tube. A spring lock 114 is provided. In this manner the door is held in a closed orientation. An operator controlled release button 116 is provided to release the spring lock and open the chamber for the dispensing of ashes. A threaded grommet 118 is provided. The threaded grommet extends radially through the supplemental tube. The threaded grommet is adapted to removably receive a cigarette to be smoked. A cigarette lighter 120 is provided. The cigarette lighter extends radially through the supplemental tube diametrically opposed to the threaded grommet. An operator controlled ignition button 122 is provided. The ignition button is adapted to light a cigarette extending through the threaded grommet. Such ignition button is an optional feature since the user could readily light the cigarette with a conventional match or lighter. Note also that smoke exhaust holes 124 are provided in the central tube adjacent to the supplemental tube.

FIG. 5A illustrates an further embodiment of the invention. Such further embodiment is similar to the embodiment of FIG. 5 but the igniter is removed thus requiring a match or lighter for igniting the tobacco.

Another alternate embodiment of the invention is illustrated in FIG. 9. In this embodiment, the portable smoke filtering system 200 includes a plurality of threaded grommets 204, 206. Each of the grommets has an interior diameter for accommodating cigarettes and cigars of different exterior diameters.

A final alternate embodiment of the invention is illustrated in FIG. 10. In this embodiment, the portable smoke filtering system 300 includes a supplemental tube 304. The supplemental tube has a forward end 306 and a rearward end 308. The forward end is threadedly coupled to the rearward end of the central tube. A chamber 310 is formed in the supplemental tube. A bowl 314 is provided. Material to be smoked 316 is provided. The bowl receives the material to be smoked. The bowl is in operative communication with the chamber.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable smoke filtering system (100) comprising:

a central tube (14) formed in a cylindrical configuration with a forward end (16) and a rearward end (18), the central tube having male screw threads (20) formed in the forward end and male screw threads (22) formed in the rearward end;

an input tube (26) formed in a cylindrical configuration with a forward end (28) and a rearward end (30), female screw threads (32) formed in the rearward end of the input tube, the forward end of the central tube being threadedly received in the rearward end of the input tube; and a first filter (44) in a cylindrical configuration with an interior surface and an exterior surface, the first filter being received in a central region of the input tube;

dryer sheets (60) located in the central tube;

a supplemental tube (104) having a forward end (106) and a rearward end (108), the forward end threadedly coupled to the rearward end of the central tube, a chamber (109) formed in the supplemental tube, a door (110) having a circular configuration, a hinge (112) pivotably coupling the door to the rearward end of the supplemental tube, a spring lock (114) holding the door in a closed orientation, an operator controlled release button (116) to release the spring lock and open the chamber for the dispensing of ashes, a threaded grommet (118) extending radially through the supplemental tube, the threaded grommet adapted to removably receive a cigarette to be smoked, a cigarette lighter (120) extending radially through the supplemental tube diametrically opposed to the threaded grommet, an operator controlled ignition button (122) adapted to light a cigarette extending through the threaded grommet, and smoke exhaust holes (124) in the central tube adjacent to the supplemental tube.

2. The system (200) as set forth in claim 1 and further including a plurality of threaded grommets (204) (206), each of the plurality of grommets having an interior diameter for accommodating cigarettes and cigars of different exterior diameters.

3. The system (300) as set forth in claim 1 and further including:

a chamber 310) formed in the supplemental tube, and a bowl (314) for the receipt of materials (316) to be smoked, the bowl being in operative communication with the chamber.

* * * * *